US005678952A

United States Patent [19]

Shaw et al.

[11] Patent Number: 5,678,952

[45] Date of Patent: Oct. 21, 1997

[54] CONCRETE DOWEL PLACEMENT APPARATUS

[76] Inventors: Lee A. Shaw, 2672 Crestview Dr., Newport Beach, Calif. 92663; Ronald D. Shaw, 1988 Pelican, Costa Mesa, Calif. 92626

[21] Appl. No.: 572,153

[22] Filed: Nov. 16, 1995

[51] Int. Cl.[6] ..... E04B 1/62; E01C 11/16

[52] U.S. Cl. ..... 404/62; 404/88; 404/136; 52/396.02

[58] Field of Search ..... 52/396.02, 396.03, 52/396.08, 704, 706; 14/73.1; 404/48, 51, 56, 59, 60, 62, 63, 65, 70, 134, 135, 136

[56] References Cited

U.S. PATENT DOCUMENTS

| | | | |
|---|---|---|---|
| 1,045,562 | 11/1912 | Kennedy . | |
| 1,592,681 | 7/1926 | Grothe . | |
| 1,838,635 | 12/1931 | Pilj . | |
| 1,852,673 | 4/1932 | Pilj . | |
| 1,939,007 | 12/1933 | Heltzel | 25/118 |
| 2,095,060 | 10/1937 | Geyer | 94/18 |
| 2,129,568 | 9/1938 | De Biasi | 72/122 |
| 2,262,704 | 11/1941 | Tompkins et al. | 72/128 |
| 2,277,203 | 3/1942 | Boult | 94/24 |
| 2,296,453 | 9/1942 | Saffert | 25/155 |
| 2,319,526 | 5/1943 | Wearn | 72/128 |
| 2,331,949 | 10/1943 | Whiteman | 72/128 |
| 2,365,550 | 12/1944 | Heltzel | 94/18 |
| 2,373,284 | 4/1945 | Autrey | 72/128 |
| 2,508,443 | 5/1950 | Carter | 94/18 |
| 2,636,426 | 4/1953 | Heltzel | 94/51 |
| 2,746,365 | 5/1956 | Darneille | 94/33 |
| 2,823,539 | 2/1958 | Kersh et al. | 72/128 |
| 3,066,448 | 12/1962 | Pinter | 50/80 |
| 3,284,973 | 11/1966 | Ames et al. | 52/155 |
| 3,333,380 | 8/1967 | Wolf | 52/365 |
| 3,451,179 | 6/1969 | Kendzia | 52/370 |
| 3,896,599 | 7/1975 | Werstein et al. | 52/704 |
| 3,920,221 | 11/1975 | Berry et al. | 256/59 |
| 3,921,356 | 11/1975 | Hughes | 52/299 |
| 4,115,976 | 9/1978 | Rohrer | 52/741 |
| 4,158,937 | 6/1979 | Henry | 52/365 |
| 4,437,828 | 3/1984 | Egger | 425/458 |
| 4,496,504 | 1/1985 | Steenson et al. | 264/69 |
| 4,533,112 | 8/1985 | Santos, Jr. et al. | 249/3 |

(List continued on next page.)

FOREIGN PATENT DOCUMENTS

| | | |
|---|---|---|
| 79813 | 8/1955 | Denmark . |
| 568457 | 10/1975 | Switzerland . |

OTHER PUBLICATIONS 3 page document entitled Continuous Dowel Support and Spacer.

9 page document from Portland Cement Association entitled Finishing Concrete Slabs, Exposed Aggregate, Patterns and Colors.

33 page document from Portland Cement Association entitled Color & Texture.

*Primary Examiner*—James Lisehora

*Attorney, Agent, or Firm*—Stetina Brunda Garred & Brucker

[57] ABSTRACT

A concrete dowel placement apparatus comprising a base member and an elongate, tubular dowel receiving sheath which is connectible to the base member. The base member comprises an outer sleeve having first and second ends, and an inner sleeve which is disposed within the outer sleeve. Extending between the inner and outer sleeves is at least one reinforcement wall. Extending about the first end of the outer sleeve is a flange portion which defines a generally flat back surface. The inner sleeve defines an aperture which extends from the second end of the outer sleeve to the back surface of the flange portion, and is sized to accommodate a fastener such as a nail to facilitate the attachment of the base member to a concrete form subsequent to the abutment of the back surface of the flange portion thereagainst. The sheath has an open proximal end, a closed distal end, and a hollow interior comportment extending longitudinally therein, with the proximal end being slidably extensible over the outer sleeve such that the outer sleeve resides within the interior compartment.

10 Claims, 4 Drawing Sheets

U.S. PATENT DOCUMENTS

| | | | |
|---|---|---|---|
| 4,578,916 | 4/1986 | Witschi | 52/396 |
| 4,614,070 | 9/1986 | Idland | 52/296 |
| 4,648,739 | 3/1987 | Thomsen | 404/2 |
| 4,752,153 | 6/1988 | Miller | 404/59 |
| 4,800,702 | 1/1989 | Wheeler | 52/677 |
| 4,883,385 | 11/1989 | Kaler | 404/56 X |
| 4,899,497 | 2/1990 | Madl, Jr. | 52/126.6 |
| 4,926,593 | 5/1990 | Johnston | 52/126.4 |
| 4,938,631 | 7/1990 | Maechtle et al. | 52/235 |
| 4,959,940 | 10/1990 | Witschi | 52/583 |
| 5,005,331 | 4/1991 | Shaw et al. | 52/396 |
| 5,134,828 | 8/1992 | Baur | 52/704 |
| 5,212,919 | 5/1993 | Shaw et al. | 52/126.6 |
| 5,216,862 | 6/1993 | Shaw et al. | 52/396 |
| 5,301,485 | 4/1994 | Shaw et al. | 52/678 |

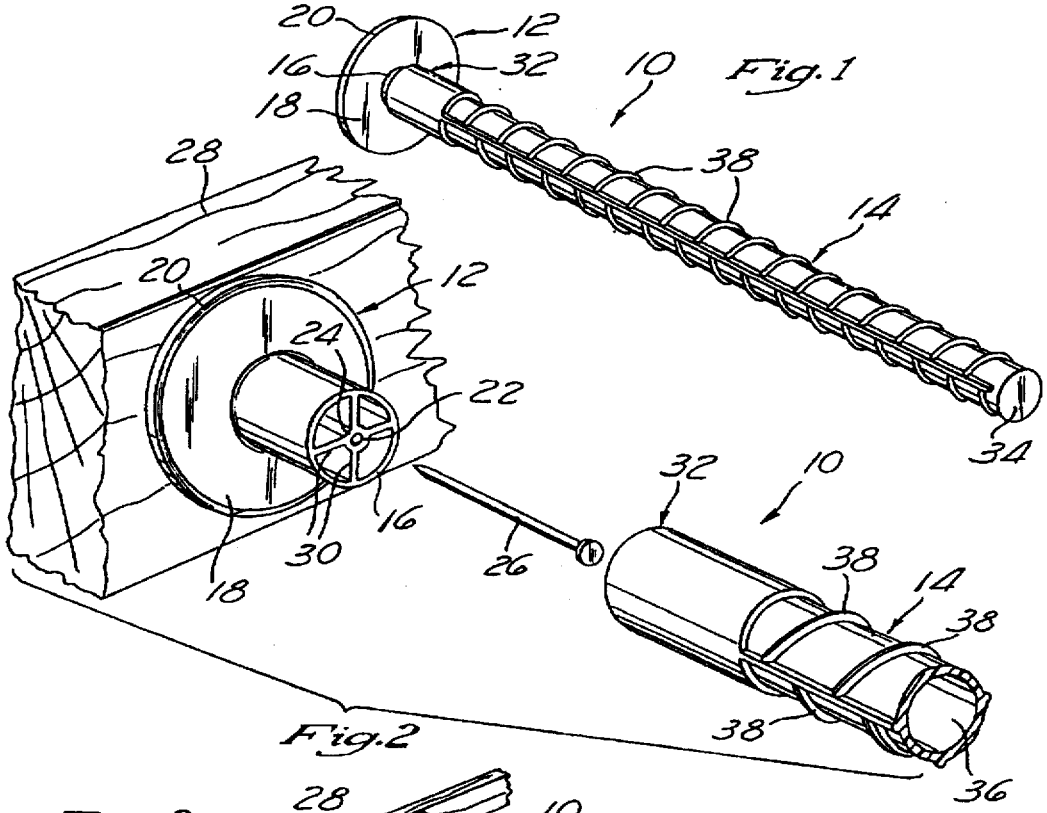
Fig. 1
Fig. 2
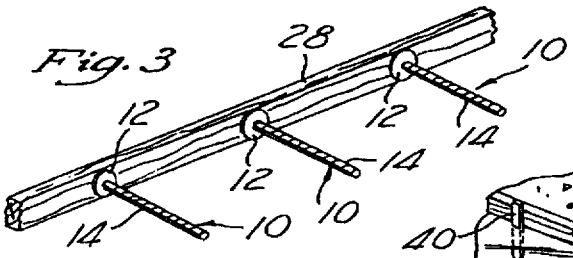
Fig. 3
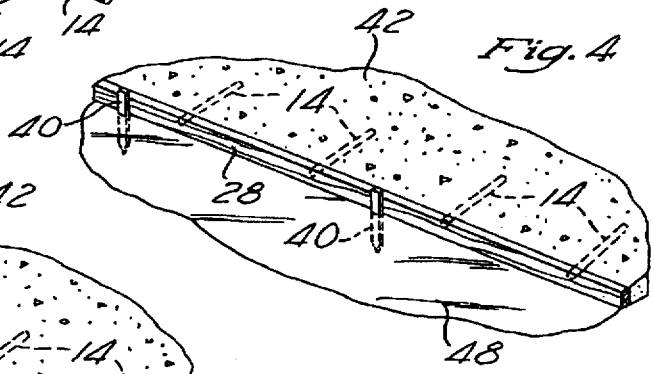
Fig. 4
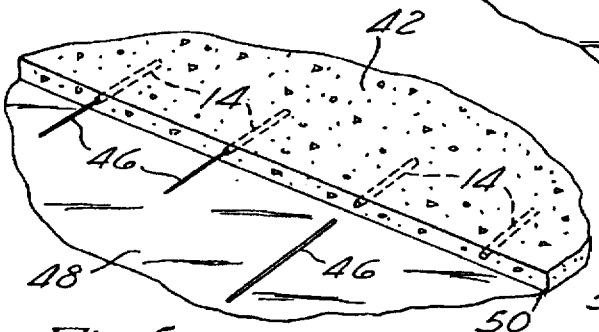
Fig. 5
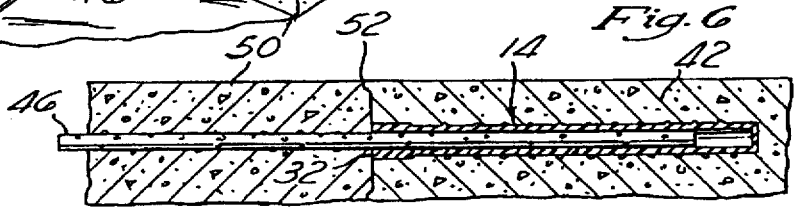
Fig. 6

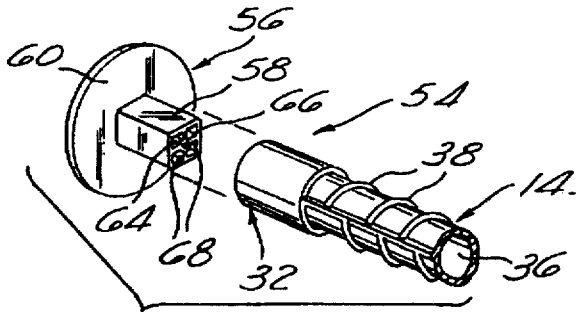
Fig. 16
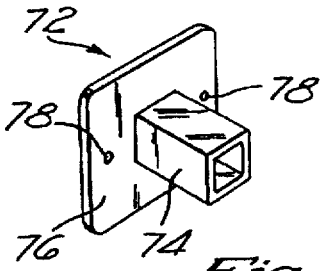
Fig. 17
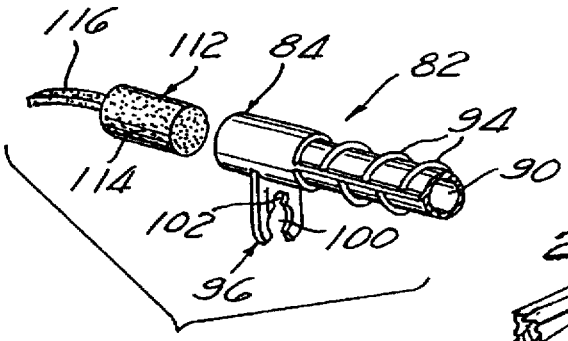
Fig. 18
Fig. 19
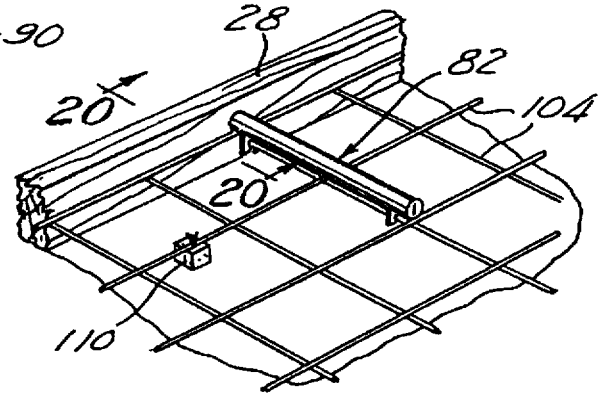
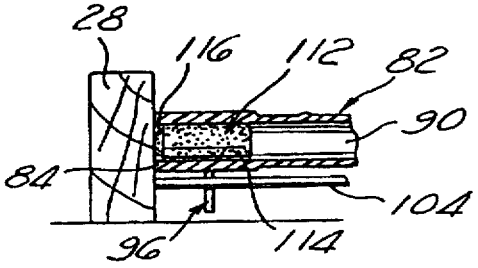
Fig. 20
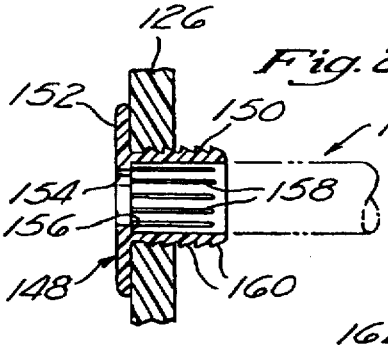
Fig. 22
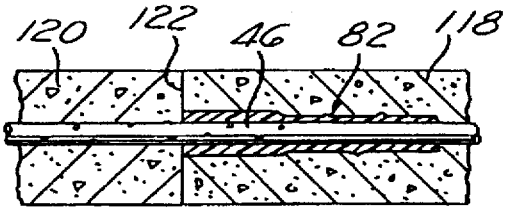
Fig. 21
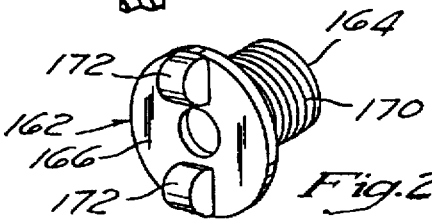
Fig. 23

CONCRETE DOWEL PLACEMENT APPARATUS

FIELD OF THE INVENTION

The present invention relates generally to the art of concrete construction, and more particularly to devices for facilitating the placement of slip dowel rods within adjacent concrete slabs.

BACKGROUND OF THE INVENTION

In the art of concrete construction, it is commonplace to form "cold joints" between two or more poured concrete slabs. Such cold joints frequently become uneven or buckled due to normal thermal expansion and contraction of the concrete and/or compaction of the underlying soil caused by inadequate substrate preparation prior to pouring of the concrete. As a means of preventing buckling or angular displacement of such cold joints, it is common practice to insert smooth steel dowel rods generally known as "slip dowels" within the edge portions of adjoining concrete slabs in such a manner that the concrete slabs may slide freely along one or more of the slip dowels, thereby permitting linear expansion and contraction of the slabs while at the same time maintaining the slabs in a common plane and thus preventing undesirable bucking or unevenness of the cold joint.

In order to function effectively, slip dowels must be accurately positioned parallel within the adjoining concrete slabs. The non-parallel positioning of the dowels will prevent the desired slippage of the dowels and will defeat the purpose of the "slip dowel" application. Additionally, the individual dowels must be placed within one or both of the slabs in such a manner as to permit continual slippage or movement of the dowels within the cured concrete slab(s).

In the prior art, two methods of installing smooth "slip dowels" have become popular. According to the first method, a first concrete pour is made within a pre-existing form. After the first pour has cured, an edge of the form (usually a wooden stud) is stripped away. A series of holes are then drilled parallel into the first pour along the exposed edge from which the form has been removed. The depth and diameter of the individual holes varies depending on the application and the relative size of the concrete slabs to be supported. As a general rule, however, such holes are at least 12 inches deep and typically have a diameter of approximately five-eighths of an inch.

After the parallel aligned series of holes has been drilled into the first pour, smooth dowel rods are advanced into each such hole such that one end of each dowel rod is positioned within the first pour and the remainder of each dowel rod extends into a neighboring area where a second slab of concrete is to be poured. Thereafter, concrete is poured into such neighboring area and is permitted to set with the parallel aligned dowels extending thereinto. After the second pour has set, the slip dowels will be held firmly within the second slab but will be permitted to slide longitudinally within the drilled holes of the first slab thereby accommodating longitudinal expansion and contraction of the two slabs while at the same time preventing buckling or angular movement therebetween.

Although the above described "drilling method" of placing slip dowels has become popular, it will be appreciated that such method is extremely labor intensive. In fact, it takes approximately ten minutes to drill a five-eighths inch diameter by twelve inches long hole into the first pour, and the drilling equipment, bits, accessories, and associated set up time tends to be very expensive. Moreover, the laborers who drill the holes and place the slip dowels must be adequately trained to insure that the dowels are arranged perpendicular to the joint but parallel to one another so as to permit the desired slippage during subsequent use.

The second popular method of placing slip dowels involves the use of wax treated cardboard sleeves positioned over one end of each individual dowel. According to such method, a series of holes are drilled through one edge of a concrete form and smooth dowels are advanced through each such hole. Wax treated cardboard sleeves are placed over one end of each dowel and the first pour is made within the form. After the first pour has set, the previously drilled form is stripped away leaving the individual dowels extending into a neighboring open space where the second pour is to be made. Subsequently, the second pour is made and permitted to cure. Thereafter, the slip dowels will be firmly held by the concrete of the second pour but will be permitted to longitudinally slide against the inner surfaces of the wax treated cardboard sleeves within the first pour. Thus, the waxed cardboard sleeves facilitate longitudinal slippage of the dowels, while at the same time holding the two concrete slabs in a common plane, and preventing undesirable buckling or angular movement thereof.

This second method, while presently popular, is nonetheless associated with numerous deficiencies. For example, after the first pour has been made, the free ends of the dowels are likely to project as much as eighteen inches through the forms and into the open space allowed for the second pour. Because the drilled section of form must be advanced over those exposed sections of dowel to accomplish stripping or removal of the form, it is not infrequent for the exposed portions of the dowels to become bent and, thus, nonparallel. Also, the drilled section of form may become damaged or broken during the removal process, thereby precluding its reuse.

It is unfortunate that both of the above-described popular methods of placing slip dowels often result in the dowels being finally positioned at various angles rather than in the desired parallel array. When such occurs, the necessary slippage of the dowels is impeded or prevented.

There is also known in the prior art dowel placement devices which comprise elongate, hollow tubes sized to receive portions of the dowel rods. The tubes are mounted to one edge of the concrete form in generally parallel relation to each other via integral base portions, with a first pour being made thereabout. After the first pour has cured, the edge of the concrete form to which the tubes are mounted is stripped away from the first slab, with dowel rods being advanced into the exposed open ends of the tubes embedded within the first slab. Those portions of the dowel rods not advanced into the tubes extend into a neighboring area where a second pour of concrete is to be made. The pouring of the concrete into the neighboring area encapsulates the dowel rods which are held firmly within the second slab formed by the curing of the second pour. The dowels, though being firmly held within the second slab, are permitted to slide longitudinally within the tubes embedded in the first slab.

Though the use of these prior art placement devices presents advantages over the previously described placement methods, these devices also possess certain deficiencies which detract from their overall utility. In particular, the attachment of the base portions of these prior art placement devices to a concrete form often requires the use of multiple fasteners, which makes the attachment process a difficult and time-consuming task. Additionally, in the prior art placement devices both the tube and its integral base portion used to facilitate the connection of the tube to the concrete form are embedded in the first slab, thus necessitating that additional placement devices be attached to the concrete form prior to its reuse. Further, the prior art placement devices are generally only suited for attachment to a concrete form, and not to reinforcement materials such as rebar or wire mesh. As such, the prior art placement devices do not lend themselves to use within the interior areas of a poured slab, but rather are limited to use along the peripheral edges of the slab which are defined by the concrete form to which the placement devices must be attached.

Accordingly, there remains a need in the art for methods and/or devices for facilitating the proper placement of slip dowels which overcome the previously described deficiencies associated with prior art placement devices.

SUMMARY OF THE INVENTION

In accordance with one embodiment of the present invention, there is provided a concrete dowel placement apparatus which comprises a base member and an elongate, tubular dowel receiving sheath which is connectible to the base member. The base member itself comprises an outer sleeve having first and second ends, and an inner sleeve which is disposed within the outer sleeve. Extending between the inner and outer sleeves is at least one reinforcement wall, while extending about the first end of the outer sleeve is a flange portion which defines a generally flat back surface. The inner sleeve defines an aperture which extends from the second end of the outer sleeve to the back surface of the flange portion, and is sized to accommodate a fastener to facilitate the attachment of the base member to a concrete form subsequent to the abutment of the back surface of the flange portion thereagainst. The sheath itself has an open proximal end, a closed distal end and a hollow interior compartment extending longitudinally therein. To facilitate the connection of the sheath to the base member, the open proximal end of the sheath is slidably extensible over the outer sleeve such that the outer sleeve resides within the interior compartment of the sheath.

The inner and outer sleeves of the base member each have generally circular cross-sectional configurations, with the inner sleeve being concentrically positioned within the outer sleeve. Additionally, the base member preferably includes four reinforcing walls extending between the inner and outer sleeves at intervals of approximately 90 degrees, with the flange portion having a generally circular configuration. The outer sleeve may alternatively have a generally square cross-sectional configuration, with the inner sleeve having a generally circular cross-sectional configuration and being centrally positioned within the square outer sleeve.

In accordance with another embodiment of the present invention, there is provided a concrete dowel placement apparatus having a base member which comprises a hollow sleeve having first and second ends, and a flange portion which extends about the first end of the sleeve and defines a generally flat back surface. Disposed within the flange portion is at least one aperture which is sized to permit the passage of a fastener such as a nail therethrough to facilitate the attachment of the base member to a concrete form subsequent to the abutment of the back surface of the flange portion thereagainst. The placement apparatus of this embodiment further includes the previously described sheath, the open proximal end of which is slidably extensible over the sleeve of the base member such that the sleeve resides within the interior compartment of the sheath. The sleeve and flange portion of the base member each have square configurations, with the flange portion including a pair of fastener receiving apertures disposed therein on opposite sides of the square sleeve.

In accordance with another embodiment of the present invention, there is provided a concrete dowel placement apparatus which comprises an elongate, tubular dowel receiving sheath having an open end, a closed end, an outer surface, and an inner surface which defines a hollow, longitudinally extending interior compartment. Formed on the outer surface of the sheath is a pair of clips which extend outwardly in spaced, generally parallel relation to each other. The clips are sized and configured to facilitate the attachment of the sheath to a piece of concrete reinforcement material.

This particular embodiment of the placement apparatus may be used in combination with a foam plug which is removably insertible into the open end of the sheath. The clips of the sheath each preferably define a first arcuate recess which is sized to receive a piece of rebar, and a second arcuate recess which is sized to receive a segment of wire mesh. The sheath itself has a generally circular cross-sectional configuration, with the clips extending radially outward from the outer surface adjacent respective ones of the open and closed ends. The outer surface of the sheath preferably includes spiral ribs formed thereon.

In accordance with another embodiment of the present invention, there is provided a concrete dowel placement apparatus wherein the base member comprises a tubular sleeve having first and second ends and inner and outer surfaces. Extending about the first end of the sleeve is a flange portion which defines generally flat front and back surfaces. The sleeve extends perpendicularly from the front surface of the flange portion. The base member is attachable to a concrete form through the extension of the sleeve through a bore in the form in a manner wherein the front surface of the flange portion is abutted thereagainst.

This particular placement apparatus further includes the previously described elongate, tubular dowel receiving sheath (not including the clips), the open proximal end of which is slidably insertible into the second end of the sleeve to facilitate the connection of the sheath to the base member. In this respect, the inner surface of the sleeve preferably includes longitudinally extending ribs formed thereon to facilitate the frictional retention of the sheath within the base member.

The base member of this placement apparatus may further comprise an annular locking ring which is extensible over the outer surface of the sleeve in a manner wherein the concrete form is captured between the flange portion and the locking ring when the base member is attached thereto. Alternatively, the outer surface of the sleeve may include barbs formed thereon to facilitate the retention of the sleeve within the bore when the base member is attached to the concrete form. Rather than including the barbs, the outer surface of the sleeve may be threaded, with the back surface of the flange portion including a pair of tabs formed thereon, the threads facilitating the retention of the sleeve within the bore when the base member is attached to the concrete form.

BRIEF DESCRIPTION OF THE DRAWINGS

These, as well as other features of the present invention, will become more apparent upon reference to the drawings wherein:

FIG. 1 is a front perspective view of a concrete dowel placement apparatus constructed in accordance with one embodiment of the present invention;

FIG. 2 is an exploded view illustrating the manner in which the base member of the placement apparatus shown in FIG. 1 is attached to a section of a concrete form;

FIG. 3 is a partial perspective view of three separate placement apparatuses as shown in FIG. 1 attached to a section of a concrete form;

FIG. 4 is a partial perspective view of a poured concrete slab abutted by the section of the concrete form shown in FIG. 3 and having a plurality of placement apparatuses as shown in FIG. 1 embedded therein;

FIG. 5 is a partial perspective view of the poured concrete slab shown in FIG. 4 having a plurality of the sheaths of the placement apparatuses shown in FIG. 1 embedded therein following the stripping away of the section of the attendant concrete form;

FIG. 6 is a longitudinal cross-sectional view of a cold joint formed between two poured concrete slabs with a slip dowel extending therebetween and positioned within the sheath of a placement apparatus as shown in FIG. 1;

FIG. 16 is an exploded view of a concrete dowel placement apparatus constructed in accordance with another embodiment of the present invention;

FIG. 17 is a perspective view of the base member of a concrete dowel placement apparatus constructed in accordance with another embodiment of the present invention;

FIG. 18 is an exploded view illustrating a foam plug which may be used with the concrete dowel placement apparatus shown in FIG. 7;

FIG. 19 is a partial perspective view illustrating the manner in which the placement apparatus shown in FIG. 18 is attached to a piece of concrete reinforcement material and interfaced to a section of a concrete form;

FIG. 20 is a cross-sectional view taken along line 20—20 of FIG. 19;

FIG. 21 is a longitudinal cross-sectional view of a cold joint formed between two poured concrete slabs with a slip dowel extending therebetween and positioned within a placement apparatus as shown in FIGS. 7 and 18–20;

FIG. 22 is a cross-sectional view of a concrete dowel placement apparatus constructed in accordance with another embodiment of the present invention; and FIG. 23 is a perspective view of a concrete dowel placement apparatus constructed in accordance with another embodiment of the present invention.

DETAILED DESCRIPTION OF THE PREFERRED EMBODIMENTS

Figure 7:
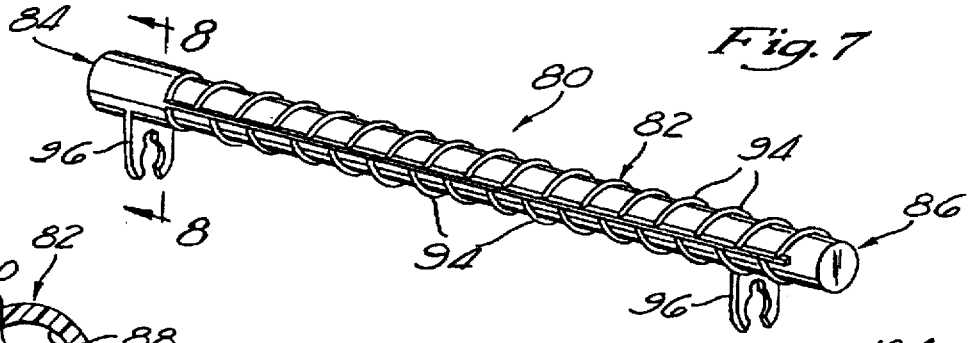
FIG. 7 is a perspective view of a concrete dowel placement apparatus constructed in accordance with another embodiment of the present invention.

Referring now to the drawings wherein the showings are for purposes for illustrating preferred embodiments of the present invention only, and not for purposes for limiting the same, FIGS. 1 and 2 illustrate a concrete dowel placement apparatus 10 constructed in accordance with a first embodiment of the present invention. The placement apparatus 10 comprises a base member 12 and an elongate, tubular dowel receiving sheath 14 which is connectible to the base member 12 in a manner which will be described in more detail below.

In the first embodiment, the base member 12 itself comprises an outer sleeve 16 which has a generally circular cross-sectional configuration. Formed on one end of the outer sleeve 16 and extending radially outward therefrom is a circularly configured flange portion 18. The flange portion 18 includes a chamfered peripheral edge 20, and defines generally planar or flat front and back surfaces, with the outer sleeve 16 extending perpendicularly (i.e., axially) from the front surface thereof.

Concentrically positioned within the outer sleeve 16 is a tubular inner sleeve 22 which also has a generally circular cross-sectional configuration. In the first embodiment, the inner sleeve 22 defines an aperture 24 which extends from the end of the outer sleeve 16 opposite that including the flange portion 18 formed thereon to the back surface of the flange portion 18. The aperture 24 is used to permit the passage of a fastener 26 such as a nail through the base member 12 to facilitate the attachment thereof to a wooden concrete form 28, as will also be discussed in more detail below. Extending between the outer and inner sleeves 16, 22 are four (4) reinforcing walls 30 which are separated from each other by intervals of approximately 90 degrees. The reinforcement walls 30 significantly increase the structural integrity of the base member 12, thereby preventing any deformation thereof when attached to the concrete form 28. The base member 12 is preferably fabricated from a plastic material, though other materials may be utilized as an alternative to plastic.

The sheath 14 of the placement apparatus 10 includes an open proximal end 32, a closed distal end 34, and an inner surface which defines a hollow, longitudinally extending interior compartment 36 therewithin. Formed on the outer surface of the sheath 14 are a plurality of spiral ribs 38. In the first embodiment, the open proximal end 32 of the sheath 14 is slidably extensible over the outer sleeve 16 in a manner wherein the outer sleeve 16 resides within the interior compartment 36. In this respect, the inner surface of the sheath 14 defining the interior compartment 36 has a diameter which slightly exceeds the outer diameter of the outer sleeve 16. As will be recognized, the outer sleeve 16 is fully extended into the interior compartment 36 when the proximal end 32 of the sheath 14 is abutted against the front surface of the flange portion 18. The sheath 14, like the base member 12, is also preferably fabricated from a plastic material.

The attachment of the placement apparatus 10 to the concrete form 28 is accomplished by initially abutting the flat back surface of the flange portion 18 against one side of the concrete form 28. As will be recognized, the overall diameter of the flange portion 18 is preferably sized so that the peripheral edge 20 thereof does not extend beyond the edges of the side of the form 28 to which the base member 12 is secured. Once the base member 12, and in particular the flange portion 18 thereof, has been properly positioned on one side of the concrete form 28, the fastener 26 is extended through the aperture 24, and driven into the form 28. The fastener 26 or nail is fully driven into the concrete form 28 when the enlarged head portion thereof comes into contact with the end of the inner sleeve 22. Subsequent to the attachment of the base member 12 to the concrete form 28, the open proximal end 32 of the sheath 14 is slidably extended over the outer sleeve 16 in the aforementioned manner. As previously indicated, neither the outer or inner sleeves 16, 22 of the base member 12 are permanently deformed when the fastener 26 is driven into the concrete form 28 by a tool such as a hammer due to the increased structural integrity provided to the base member 12 by the inclusion of the reinforcement walls 30.

The manner in which multiple placement apparatuses 10 are typically employed is illustrated in FIGS. 3–6. As shown, a series of placement apparatuses 10 are fixed to a common side of the concrete form 28 in equidistantly spaced relation to each other, such that the sheaths 14 extend perpendicularly from the common side of the concrete form 28 in substantially parallel relation to each other. The attachment of each placement apparatus 10 to the form 28 is accomplished in the previously described manner, i.e., by driving the fastener 26 through the base member 12 and into the form 28. Thereafter, the form 28 is held firmly in position by stakes 40, as seen in FIG. 4. A first concrete pour is then made within the form 28 which encapsulates the sheaths 14 as well as the front surfaces of the flange portions 18 which remain exposed. Upon curing, the first pour forms a first concrete slab 42.

After the first slab 42 is set, the form 28 is stripped away therefrom. Importantly, when the form 28 is stripped away, the base members 12 of the placement apparatuses 10 remain in attachment thereto, with the flange portions 18 being removed from within the first slab 42 and the outer sleeves 16 being pulled from within the interior compartments 36 of the sheaths 14. The removal of the flange portions 18 from within the first slab 42 is aided by the chamfered configuration of the peripheral edges 20 thereof. Additionally, the circular configuration of the flange portions 18 prevents cracking in the edge of the first slab 42 which often occurs at the corner regions of square or rectangular flanges. Thus, only the sheaths 14 remain embedded within the first slab 42, with the open proximal ends 32 thereof being centrally positioned within circularly configured recesses defined in the edge of the first slab 14 by the removal of the flange portions 18 from therewithin. The adhesion of the poured concrete to the sheaths 14 is enhanced by the inclusion of the spiral ribs 38 thereon.

As seen in FIG. 5, after the form 28 has been stripped away from the first slab 42 (thus separating the base members 12 from the sheaths 14), sections of dowel rod 46 are advanced into respective ones of the sheaths 14 embedded in the first slab 42 via the exposed open proximal ends 32 thereof. The dowel rods 46 may be smooth, or may alternatively be formed of segments of conventional rebar. The portions of the dowel rods 46 advanced into the sheaths 14 remained slidably disposed therein, with the remaining portions of the dowel rods 46 extending outwardly into an adjacent space 48 wherein a second concrete pour is to be made.

As seen in FIG. 6, a second pour of concrete is then made into the space 48 which completely encapsulates the exposed portions of the dowel rods 46. The second pour of concrete is then allowed to set thereby forming a second concrete slab 50. A cold joint or seam 52 extends between the first and second slabs 42, 50. Importantly, through the use of the placement apparatuses 10, the dowel rods 46 remain parallel to one another and longitudinally slidable within the sheaths 14 embedded in the first slab 42, while being firmly cured in place within the second slab 50. By such arrangement, the first and second slabs 42, 50 are permitted to undergo longitudinal expansion and contraction along the dowel rods 46 while at the same time being prevented from buckling or undergoing vertical or angular displacement at the cold joint or seam 52. As further seen in FIG. 6, the circularly configured recesses in the first slab 42 which are created by the removal of the flange portions 18 from therewithin are filled by the second pour, thus eliminating the formation of any voids between the abutting edges of the first and second concrete slabs 42, 50.

As previously explained, the base members 12 of the placement apparatuses 10 remain in attachment to the concrete form 28 when the same is stripped away from the first slab 42. As such, the form 28 may be quickly re-used after additional sheaths 14 are slidably extended over the outer sleeves 16 of the base members 12. Indeed, the process of attaching the base members 12 to the concrete form 28 need only be conducted a single time, with the form 28 and accompanying base members 12 being reusable after each slab is poured simply by connecting new sheaths 14 thereto. The attachment of each base member 12 to the form 28 via a single fastener 26 and reusability of the base members 12 provides a significant advancement over prior art placement devices which comprise a sheath portion and integral base portion. The base portion is used to attach the prior art placement device to the concrete form, with multiple fasteners being needed to facilitate such attachment. Once the concrete form is stripped away from the slab, the prior art placement devices (comprising the integrally connected sheath and base portions) are, in their entirety, embedded within the concrete form. Thus, prior to the re-use of the concrete form, the base portions of new placement devices must be secured thereto, which is a time consuming and therefore an expensive process.

Referring now to FIG. 16, there is depicted a concrete dowel placement apparatus 54 constructed in accordance with a second embodiment of the present invention which constitutes a slightly modified version of the previously described placement apparatus 10 constructed in accordance with the first embodiment. The placement apparatus 54 comprises a base member 56 which, like the previously described base member 12, comprises an outer sleeve 58 having a circularly configured flange portion 60 extending radially outward from one end thereof. The flange portion 60 also includes a chamfered peripheral edge 62, and defines generally planar front and back surfaces, with the outer sleeve extending perpendicularly from the front surface thereof. However, rather than having a circular cross-sectional configuration like the previously described outer sleeve 16, the outer sleeve 58 of the base member 56 has a generally square cross-sectional configuration.

Centrally positioned within the outer sleeve 58 is a tubular inner sleeve 64 which has a generally circular cross-sectional configuration and defines an aperture 66 extending from the end of the outer sleeve 58 opposite that including the flange portion 60 formed thereon to the back surface of the flange portion 60. The aperture 66 is used for the same purpose as the aperture 24 of the base member 12. Extending between the outer and inner sleeves 58, 64 are four (4) reinforcing walls 68 which are separated from each other by intervals of approximately 90 degrees, and are used to increase the structural integrity of the base member 56. The base member 56 is also preferably fabricated from a plastic material.

In addition to the base member 56, the placement apparatus 54 also includes the previously described sheath 14, the open proximal end 32 of which is slidably extensible over the outer sleeve 58 in a manner wherein the outer sleeve 58 resides within the interior compartment 36 of the sheath 14. As will be recognized, the inner surface of the sheath 14 defining the interior compartment 36 has a diameter which slightly exceeds the distance separating the diagonally opposed corners of the outer sleeve 58 from each other. The outer sleeve 58 of the base member 56 is fully extended into the interior compartment 36 when the proximal end 32 of the sheath 14 is abutted against the front surface of the flange portion 60. The placement apparatus 54 constructed in accordance with the second embodiment is used in the same manner as the placement apparatus 10 of the first embodiment.

Referring now to FIG. 17, there is depicted the base member 72 of a placement apparatus constructed in accordance with a third embodiment of the present invention. The base member 72 comprises a hollow sleeve which has a generally square cross-sectional configuration. Formed on one end of the sleeve 74 and extending outwardly therefrom a generally square flange portion 76 which defines flat front and back surfaces and includes radiused corner regions. The sleeve 74 extends perpendicularly from the front surface of the flange portion 76.

Disposed within the flange portion 76 on opposite sides of the sleeve 74 is a pair of apertures 78, each of which is sized to permit the passage of a fastener such as a nail therethrough to facilitate the attachment of the base member 72 to a concrete form subsequent to the abutment of the back surface of the flange portion 76 against the form. Though not shown, the placement apparatus of the third embodiment which includes the base member 72 further includes the previously described sheath 14, the open proximal end 32 of which is slidably extensible over the sleeve 74 in a manner wherein the sleeve 74 resides within the interior compartment 36 of the sheath 14. In this respect, the inner surface of the sheath 14 defining the interior compartment 36 has a diameter which slightly exceeds the distance separating the diagonally opposed corners of the square sleeve 74 from each other. The sleeve 74 is fully extended into the interior compartment 36 when the proximal end 32 of the sheath 14 is abutted against the front surface of the flange portion 76. The base member 72 is also preferably fabricated from a plastic material.

Figure 8:
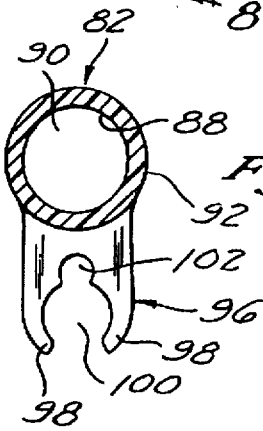
FIG. 8 is a cross-sectional view taken along line 8—8 of FIG. 7.

Referring now to FIGS. 7 and 8, there is depicted a concrete dowel placement apparatus 80 constructed in accordance with a fourth embodiment of the present invention. The placement apparatus 80 comprises an elongate, tubular dowel receiving sheath 82 which has a generally circular cross-sectional configuration and includes an open end 84, a closed end 86, and an inner surface 88 which defines a hollow, longitudinally extending interior compartment 90 therewithin. Formed on the outer surface 92 of the sheath 82 are spiral ribs 94.

Figure 10:
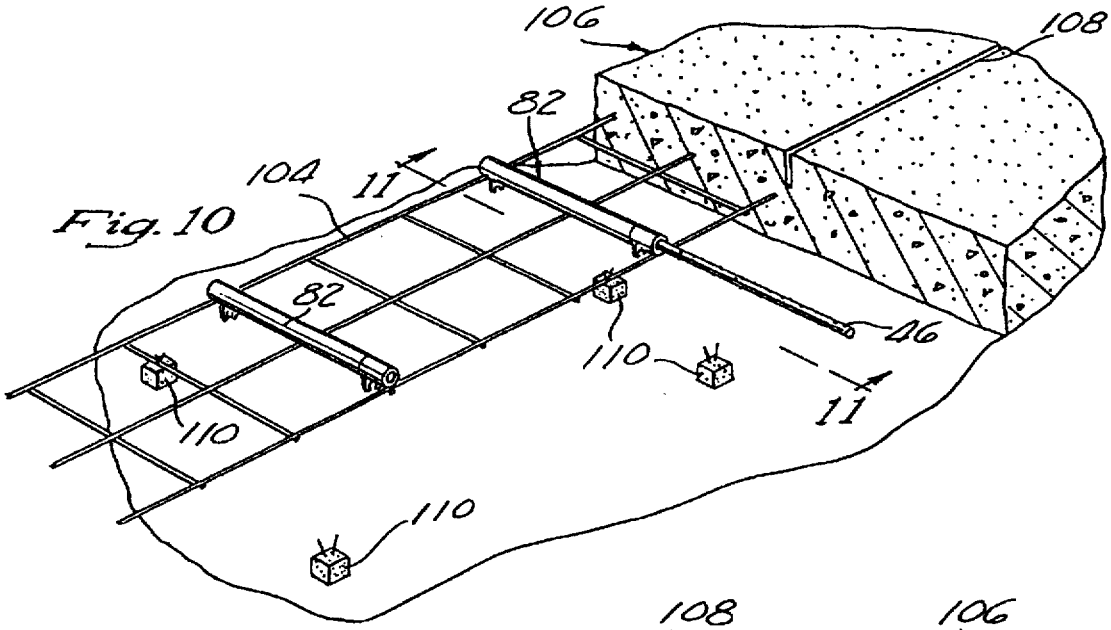
FIG. 10 is a partial perspective view illustrating the manner in which the placement apparatus shown in FIG. 7 is attached to a piece of concrete reinforcement material prior the pouring of the concrete slab.
Figure 11:
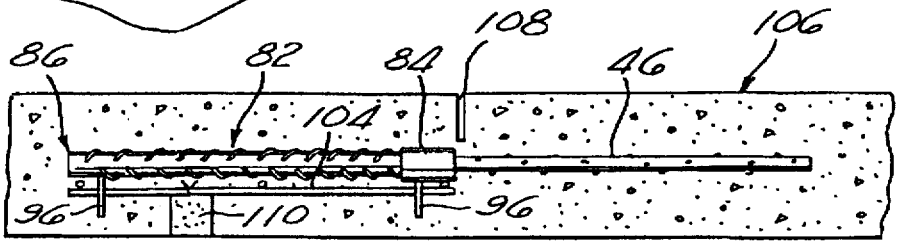
FIG. 11 is a cross-sectional view taken along line 11—11 of FIG. 10.

In the fourth embodiment, the sheath 82 includes a pair of integral clips 96 which are formed on and extend radially outward from the outer surface 92 in spaced, generally parallel relation to each other. The clips 96 are identically configured, and are positioned in close proximity to respective ones of the open and closed ends 84, 86 of the sheath 82. As will be discussed in more detail below, the clips 96 are each sized and configured to facilitate the attachment of the sheath 82 to a piece of concrete reinforcement material. As seen in FIG. 8, each of the clips 96 includes a pair of flexible prong portions 98. Defined between the prong portions 98 is a first arcuate recess 100 and a second arcuate recess 102 which is substantially smaller than the first recess 100 and disposed closer to the outer surface 92 of the sheath 82. In the placement apparatus 80, the first recess 100 is sized and configured to receive a piece of rebar, with the second recess 102 being sized and configured to receive a segment of wire mesh 104, as seen in FIGS. 10 and 11. The sheath 82 is also preferably fabricated from a plastic material, though other materials may be utilized as an alternative to plastic.

Figure 9:
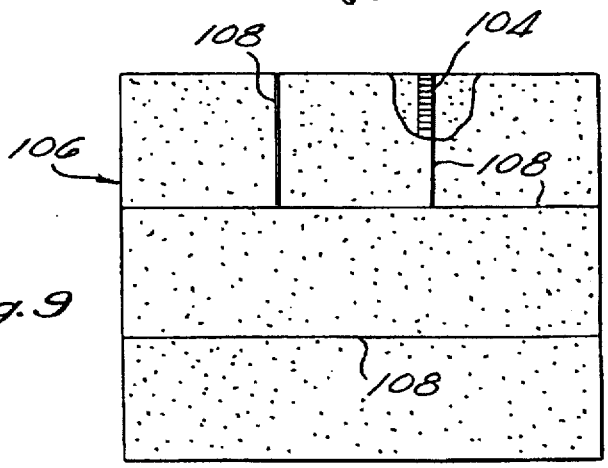
FIG. 9 is a top plan view of a concrete slab in which the placement apparatus shown in FIG. 7 is preferably used.

Referring now to FIGS. 9–11, placement apparatuses 80 constructed in accordance with the fourth embodiment are typically used in conjunction with monolithic concrete pours rather than in the cold joint doweling application previously described in relation to the placement apparatus 10 of the first embodiment. The use of monolithic pours is a common practice in construction. In monolithic pours, concrete is poured in large quantities without proper jointing primarily for purposes of cutting costs. As seen in FIG. 9, in typical monolithic pours fracturing is prevented within the cured concrete slab 106 by including tooled joints or sawcuts 108 in the slab 106 where cold joints would otherwise be needed. Additionally, as seen in FIGS. 9–11, concrete reinforcement material such as the wire mesh 104 (or alternatively segments of rebar) is initially placed into the area in which the monolithic pour is to be made, and in particular those areas where it is contemplated that sawcuts 108 will be included in the resultant slab 106 for purposes of preventing the fracturing thereof. The wire mesh 104 or other reinforcement material is preferably elevated above ground level by the placement thereof upon support blocks or "chairs" 110 in the manner shown in FIGS. 10 and 11.

In addition to having concrete reinforcement material disposed within those portions of the slab 106 in which a sawcut 108 is to be made, it is also desirable to incorporate slip dowels into such portions to allow the separate sections of the slab 106 which are defined by the sawcuts 108 to move relative to each other while preventing any buckling or angular displacement thereof. One prior art method of incorporating slip dowels into those areas of a monolithic pour where it is contemplated that sawcuts will be made involves manually "stabbing" the slip dowels into predetermined locations of the uncured concrete pour. However, this method is deficient in that there is no way to insure that the slip dowels will be manually positioned within the uncured concrete in parallel relation to each other, or will be maintained in parallel alignment as the top surface of the concrete pour is being finished. As previously explained, if the dowel rods are not in parallel alignment, the separate sections of the slab defined by the sawcuts will be prevented from moving relative to each other. Another prior art method of incorporating slip dowels into a monolithic pour involves manually tieing the slip dowels to the reinforcement material in parallel relation to each other prior to the concrete pour being made. However, this manual tieing is extremely time consuming, and presents significant difficulties in attempting to secure the slip dowels to the reinforcement material in true parallel relation to each other. Additionally, the tied slip dowels are susceptible to displacement or shifting when impacted by the concrete during the pour thus moving the same out of parallel alignment with each other.

The placement apparatus 80 constructed in accordance with the fourth embodiment eliminates the deficiencies associated with the prior art, and facilitates the quick and easy placement of sheaths 82 and accompanying dowel rods 46 into those areas of the slab 106 in which sawcuts 108 are to be included. Referring again to FIGS. 10 and 11, the concrete reinforcement material used within the slab 106 is the wire mesh 104. Multiple sheaths 82 are secured to the wire mesh 104 in spaced, generally parallel relation to each other via their clips 96 such that the open ends 84 thereof extend in generally co-planar relation to each other. The attachment of each sheath 82 to the wire mesh 104 is facilitated by the receipt of a straight segment of the wire mesh 104 into the second recesses 102 of the clips 96 of the sheath 82. Importantly, the receipt of the wire mesh segment into the second recesses 102 facilitates a slight outward flexion of the prong portions 98, thus causing the wire mesh segment to be frictionally retained within the second recesses 102. After the sheaths 82 have been secured to the wire mesh 104, segments of dowel rod 46 are advanced into respective ones of the interior compartments 90, with portions of the dowel rods 46 protruding axially from the open ends 84 of the sheaths 82, as seen in FIGS. 10 and 11. Importantly, the placement apparatuses 80 are preferably oriented so that each sawcut 108 will extend in generally co-planar relation to the open ends 84 of the sheaths 82. As previously indicated, the dowel rods 46 advanced into the interior compartments 90 of the sheaths 82 may be smooth or may alternatively comprise segments of conventional rebar.

As will be recognized, subsequent to the attachment of the sheaths 82 to the wire mesh 104 and advancement of the dowel rods 46 thereinto, the concrete is poured, with the wire mesh 104, chairs 110 and placement apparatuses 80 (including the sheaths 82 and dowel rods 46) being completely encapsulated thereby. After the resultant slab 106 is cured, the sawcuts 108 are made therein. Though portions of the dowel rods 46 are held firmly within the slab 106, those portions disposed within the interior compartments 90 of the sheaths 82 are free to slide longitudinally therewithin, thus allowing separate sections of the slab 106 which are defined by the sawcuts 108 to move relative to each other. The adhesion of the poured concrete to the sheaths 82 is aided by the spiral ribs 94 formed on the outer surfaces 92 thereof. In the event rebar is used as the concrete reinforcement material as an alternative to the wire mesh 104, the placement apparatuses 80 are used in the same manner previously described, except that straight segments of the rebar are inserted into and frictionally retained within the larger size first recesses 100 of the clips 96 formed on the sheaths 82.

Referring now to FIGS. 18–21, as previously explained, the placement apparatus 80 constructed in accordance with the fourth embodiment is typically used in monolithic concrete pours since it need not be attached to a concrete form and may be placed inwardly of the form which defines the periphery of the poured concrete slab. However, the placement apparatus 80 may also be used in cold joint applications with the previously described wooden concrete form 28 as an alternative to the placement apparatuses of the first, second and third embodiments.

In particular, it is contemplated that the sheath 82 may be used in combination with a complimentary foam plug 112 which is removably insertible into the open end 84. The foam plug 112 itself comprises a cylindrically shaped body portion 114 having an elongate tail portion 116 extending axially from one end thereof. When fully inserted into the open end 84 of the sheath 82, the body portion 114 resides within the interior compartment 90, with the tail portion 116 protruding from the open end 84. After the foam plug 112 has been inserted thereinto, the sheath 82 may be secured to the wire mesh 104 (or to the rebar) in the previously described manner. However, since the placement apparatus is being used to form a cold joint rather than being used in a monolithic pour, the sheath 82 must be oriented on the wire mesh 104 such that the open end 84 thereof is flush with or extends beyond the edge of the wire mesh 104 and is abutted against one side of the concrete form 28, as seen in FIGS. 19 and 20. Due to the foam construction of the plug 112, the abutment of the open end 84 of the sheath 82 against the concrete form 28 causes the tail portion 116 to be compressed between the form 28 and body portion 114 of the plug 112.

After the concrete has been poured within the form 28 and cures into a resultant slab 118, the form 28 is stripped away from the slab 118. Importantly, the stripping away of the form 28 allows the compressed tail portions 116 of the foam plugs 112 to resiliently return to their uncompressed, extended configurations. The tail portions 116 are then grasped and pulled outwardly, thus removing the foam plugs 112, and in particular the body portions 114 thereof, from within the interior compartments 90 of the sheaths 82. The dowel rods 46 are then advanced into respective ones of the sheaths 82 embedded in the slab 118 via the exposed open ends 84 thereof. The portions of the dowel rods 46 advanced into the sheaths 82 remain slidably disposed therein, with the remaining portions of the dowel rods 46 extending outwardly into an adjacent space wherein a second concrete pour is to be made.

As seen in FIG. 21, a second pour of concrete is then made which completely encapsulates the exposed portions of the dowel rods 46. The second pour of concrete is then allowed to set, thereby forming another concrete slab 120. A cold joint or seam 122 extends between the slabs 118, 120. Through the use of the placement apparatuses 80, the dowel rods 46 remain parallel to one another and longitudinally slidable within the sheaths 82 embedded in the slab 118, while being firmly cured in place within the slab 120. By such arrangement, the slabs 118, 120 are permitted to undergo longitudinal expansion and contraction along the dowel rods 46, while at the same time being prevented from buckling or undergoing vertical or angular displacement at the cold joint or seam 122.

Though not shown, it is known in the prior art to provide the wire mesh 104 concrete reinforcement material in rolls. In this respect, it is contemplated that the sheaths 82 may be pre-attached to the wire mesh 104 in desired locations prior to it being rolled for delivery. As such, upon being unrolled within the confines of a concrete form, the wire mesh 104 will already include the sheaths 82 operatively placed thereupon.

Referring now to FIGS. 12–15, there is depicted a concrete dowel placement apparatus 124 constructed in accordance with a fifth embodiment of the present invention. The placement apparatus 124 is adapted to be used in conjunction with a concrete form 126 which is intended to remain embedded between a first slab 128 and an adjacent second slab 130 to form an intermediate cold joint. In the fifth embodiment, the concrete form 126 is preferably fabricated from a fiber reinforced foamed plastic material, and includes a plurality of bores 132 pre-drilled thereinto in equidistantly spaced relation to each other.

Figure 14:
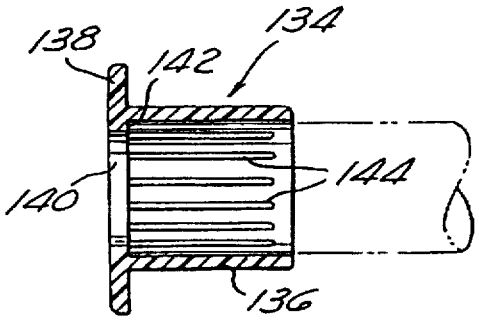
FIG. 14 is a side elevational view of the placement apparatus shown in FIGS. 12 and 13, illustrating the manner in which the sheath is inserted into the base member.

The placement apparatus 124 comprises a base member 134 and the previously described elongate, tubular sheath 14 which is connectible to the base member 134. The base member 134 itself comprises a tubular sleeve 136 which has a generally circular cross-sectional configuration. Formed on one end of the sleeve 136 and extending radially outward therefrom is a circularly configured flange portion 138 which defines generally planar or flat front and back surfaces. In this respect, the sleeve 136 extends perpendicularly (i.e., axially) from the front surface of the flange portion 138. As best seen in FIG. 14, the flange portion 138 defines a centrally positioned circular opening 140 which communicates with the interior of the sleeve 136, and an annular shoulder 142 which extends radially inward relative to the inner surface of the sleeve 136. Formed on the inner surface of the sleeve 136 in equidistantly spaced relation to each other are a plurality of longitudinally extending ribs 144 which terminate slightly inwardly from the end of the sleeve 136 opposite that including the flange portion 138 formed thereon.

Figure 12:
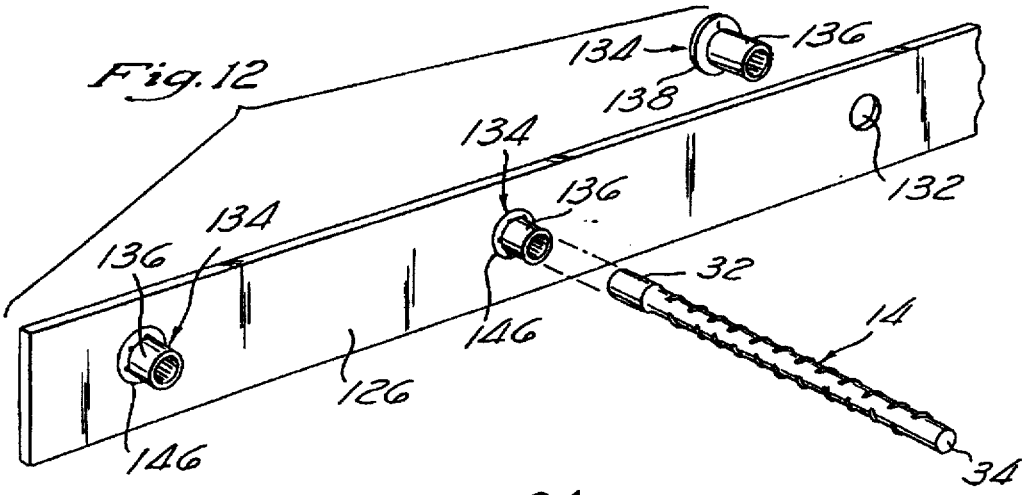
FIG. 12 is a perspective view of a dowel placement apparatus constructed in accordance with another embodiment of the present invention, illustrating the manner in which the placement apparatus is attached to a concrete form.
Figure 13:
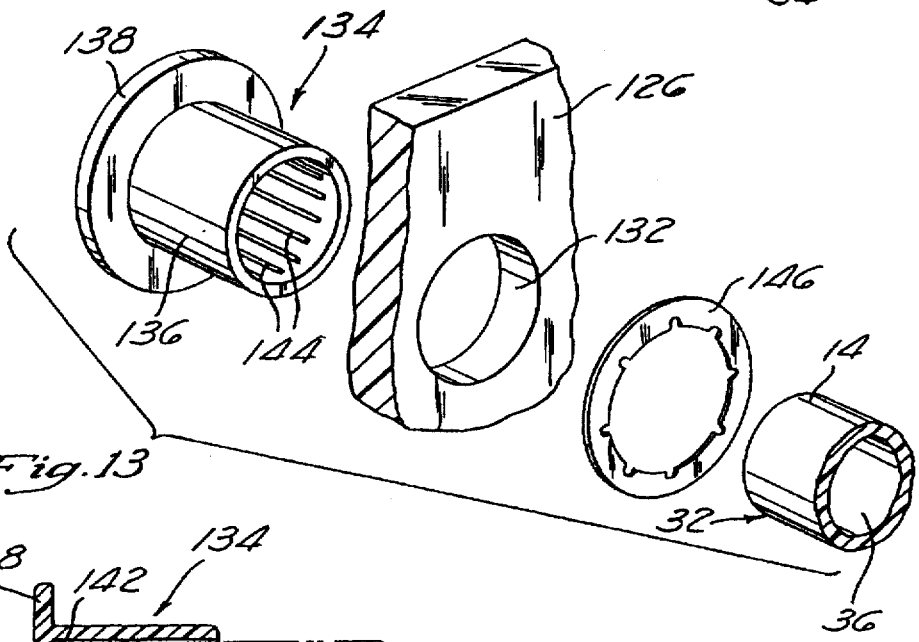
FIG. 13 is an exploded view of the components comprising the base member of the placement apparatus shown in FIG. 12.
Figure 15:
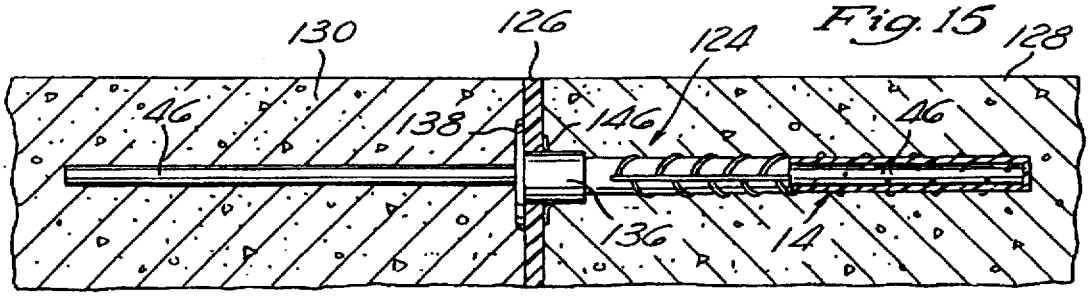
FIG. 15 is a longitudinal cross-sectional view of a cold joint formed between two poured concrete slabs with a slip dowel extending therebetween and positioned within the concrete dowel placement apparatus shown in FIGS. 12 and 13.

As best seen in FIGS. 12 and 13, the base member 134 is attached to the form 126 via the slidable extension of the sleeve 136 through a respective bore 132. Each bore 132 is sized having a diameter which slightly exceeds the diameter of the outer surface of the sleeve 136, thus allowing the same to be slidably inserted thereinto. The base member 134 is fully inserted into the form 126 when the front surface of the flange portion 138 is abutted against one side of the form 126, as seen in FIG. 15. The sleeve 136 is sized having a length such that the end thereof not including the flange portion 138 protrudes from the side of the form 126 opposite that including the front surface of the flange portion 138 abutted thereagainst.

To maintain the base member 134 in firm engagement to the form 128 subsequent to the extension of the sleeve 136 through the bore 132 in the aforementioned manner, the placement apparatus 124 is further provided with an annular locking ring 146. The locking ring 146 is sized and configured to be extensible over the outer surface of the sleeve 136 and abutted against the concrete form 126 such that the form 126 is captured between the front surface of the flange portion 138 and locking ring 146. Subsequent to the attachment of the base member 134 to the form 128 through the use of the locking ring 146, the open proximal end 32 of the sheath 14 is slidably extended into the sleeve 136. The extension of the sheath 14 into the base member 34 is limited by the abutment of the open proximal end 32 against the annular shoulder 142. When such abutment occurs, the opening 140 and interior compartment 36 (which are of substantially equal diameter) are aligned with each other. Importantly, the sheath 14 is frictionally retained within the base member 134 by the ribs 144 formed on the inner surface of the sleeve 136.

Referring now to FIG. 15, after the base members 134 have been attached to the form 126 and the sheaths 14 connected to the base members 134, dowel rods 46 are slidably advanced into the interior compartments 36 of respective ones of the sheaths 14 via the openings 140 in the flange portions 138. Thereafter, a first concrete pour is made which encapsulates the sheaths 14 and portions of the sleeves 136, and cures into the first slab 128. A second concrete pour is then made which encapsulates the flange portions 138 and exposed portions of the dowel rods 46, and cures into the second slab 130. Once again, the portions of the dowel rods 46 advanced into the sheaths 14 remain slidably disposed therein, with the remaining portions of the dowel rods being firmly cured in place within the second slab 130. As such, the first and second slabs 128, 130 are permitted to undergo longitudinal expansion and contraction along the dowel rods 46, while at the same time being prevented from buckling or undergoing vertical or angular displacement at the form 126. It will be recognized that the form 126 may be provided with the base members 134 being pre-attached thereto.

Referring now to FIG. 22, there is depicted a base member 148 which may be used in the placement apparatus 124 as an alternative to the previously described base member 134. The base member 148 includes a sleeve 150 which has a generally circular cross-sectional configuration. Formed on one end of the sleeve 150 and extending radially outward therefrom is a circularly configured flange portion 152 which defines generally flat front and back surfaces. The sleeve 150 extends perpendicularly (i.e., axially) from the front surface of the flange portion 152. The flange portion 152 further defines a central opening 154 which communicates with the interior of the sleeve 150 and an annular shoulder 156 which extends radially inward relative to the inner surface of the sleeve 150. Formed on the inner surface of the sleeve 150 in equidistantly spaced relation to each other are a plurality of longitudinally extending ribs 158 which extend to the shoulder 156 and terminate slightly inwardly from the end of the sleeve 150 opposite that including the flange portion 152 formed thereon.

The base member 148 is also attached to the form 126 by the extension of the sleeve 150 through a respective bore 132. When the base member 148 is fully inserted into the form 126, the front surface of the flange portion 152 is abutted against one side of the form 126, with the end of the sleeve 150 opposite that including the flange portion 152 formed thereon protruding from the other side of the form 126. However, as an alternative to the use of the previously described locking ring 146, the base member 148 is maintained in rigid attachment to the form 126 by the engagement of barbs 160 formed on the outer surface of the sleeve 150 to the form 126. The barbs 160 are directed toward the flange portion 152, thus allowing the same to be forced through the bore 132. Once forced through the bore 132, the barbs 160 frictionally retain the sleeve 150, and hence the base member 148, within the form 126. The sheath 14 is connected to the base member 148 in the same manner previously described in relation to the connection of the sheath 14 to the base member 134, i.e., by the slidable insertion of the open proximal end 32 into the sleeve 150, with such insertion being limited by the abutment of the open proximal end 32 against the annular shoulder 156. Once inserted into the base member 148, the sheath 14 is frictionally maintained within the sleeve 150 by the ribs 148 formed on the inner surface thereof.

Referring now to FIG. 23, there is depicted a base member 162 which may also be utilized in the placement apparatus 124 as an alternative to the base member 134. The base member 162 itself comprises a sleeve 164 which has a generally circular cross-sectional configuration. Formed on one end of the sleeve 164 and extending radially outward therefrom is a circularly configured flange portion 166 which defines generally flat front and back surfaces. The sleeve 164 extends perpendicularly (i.e., axially) from the front surface of the flange portion 166. The flange portion 166 further defines a central opening 168 which communicates with the interior of the sleeve 164 and an annular shoulder which extends radially inward relative to the inner surface of the sleeve 164. Additionally, formed on the inner surface of the sleeve 164 in equidistantly spaced relation to each other are a plurality of longitudinally extending ribs which extend to the shoulder defined by the flange portion 166 and terminate slightly inward of the end of the sleeve 164 opposite that including the flange portion 166 formed thereon.

As an alternative to the previously described barbs 160 formed on the outer surface of the sleeve 150, the sleeve 164 of the base member 162 includes threads 170 formed on the outer surface thereof. Additionally, formed on the back surface of the flange portion 166 in opposed relation to each other and on opposite sides of the opening 168 is a pair of identically configured, semi-circular tab portions 172. Like the barbs 160, the threads 170 are adapted to serve as an alternative to the locking ring 146 to facilitate the retention of the base member 162 within the form 126. In this respect, the sleeve 164 is extended through the bore 132 by rotating it through the use of the tab portions 172. The continued rotation of the sleeve 164 causes the same to be drawn through the bore 132 until such time as the front surface of the flange portion 166 comes into abutting contact with one side of the form 126. When such abutment occurs, the end of the sleeve 164 not including the flange portion 166 formed thereon protrudes from the side of the form 126 opposite that against which the flange portion 166 is abutted. Thereafter, the sheath 14 is connected to the base member 162 in the same manner as previously described in relation to the connection of the sheath 14 to the base members 148, 134.

Additional modifications and improvements of the present invention may also be apparent to those skilled in the art. For example, the flange portion and/or sleeve of each base member may be provided in any geometric shape (e.g., circular, square, triangular, etc.), as may each sheath. Thus, the particular combination of parts described and illustrated herein is intended to represent only certain embodiments of the present invention, and is not intended to serve as limitations of alternative devices within the spirit and scope of the invention.

What is claimed is:

1. A concrete dowel placement apparatus, comprising:

a base member comprising:

an outer sleeve having first and second ends;

an inner sleeve disposed within the outer sleeve;

at least one reinforcement wall extending between the inner and outer sleeves; and a flange portion extending about the first end of the outer sleeve and defining a generally flat back surface;

said inner sleeve defining an aperture which extends from the second end of the outer sleeve to the back surface of the flange portion and is sized to accommodate a fastener to facilitate the attachment of the base member to a concrete form subsequent to the abutment of the back surface of the flange portion thereagainst;

an elongate, tubular dowel receiving sheath having an open proximal end, a closed distal end, and a hollow interior compartment extending longitudinally therein;

the open proximal end of the sheath being slidably extensible over the outer sleeve such that the outer sleeve resides within the interior compartment.

2. The placement apparatus of claim 1 wherein said inner and outer sleeves each have generally circular cross-sectional configurations, and said inner sleeve is concentrically positioned within said outer sleeve.

3. The placement apparatus of claim 1 wherein said outer sleeve has a generally square cross-sectional configuration and said inner sleeve has a generally circular cross-sectional configuration, said inner sleeve being centrally positioned within said outer sleeve.

4. The placement apparatus of claim 1 wherein said base member includes four reinforcing walls extending between the inner and outer sleeves at intervals of approximately 90 degrees.

5. The placement apparatus of claim 1 wherein said flange portion has a generally circular configuration.

6. A concrete dowel placement apparatus, comprising:

a base member comprising:

an outer sleeve having first and second ends;

an inner sleeve disposed within the outer sleeve;

at least one reinforcement wall extending between the inner and outer sleeves; and a flange portion extending about the first end of the outer sleeve and defining a back surface;

said inner sleeve defining an aperture which extends from the second end of the outer sleeve to the back surface of the flange portion;

a dowel receiving sheath having an open proximal end, a closed distal end, and a hollow interior compartment extending longitudinally therein;

the open proximal end of the sheath being extensible over the outer sleeve such that at least a portion of the outer sleeve resides within the interior compartment.

7. The placement apparatus of claim 6 wherein said inner and outer sleeves each have generally circular cross-sectional configurations, and said inner sleeve is concentrically positioned within said outer sleeve.

8. The placement apparatus of claim 6 wherein said outer sleeve has a generally square cross-sectional configuration and said inner sleeve has a generally circular cross-sectional configuration, said inner sleeve being centrally positioned within said outer sleeve.

9. The placement apparatus of claim 6 wherein said base member includes four reinforcing walls extending between the inner and outer sleeves at intervals of approximately ninety degrees.

10. The placement apparatus of claim 6 wherein said flange portion has a generally circular configuration.

* * * * *